US008920288B2

(12) United States Patent
Dalebout et al.

(10) Patent No.: US 8,920,288 B2
(45) Date of Patent: Dec. 30, 2014

(54) EXERCISE DEVICE WITH FAN CONTROLLABLE BY A PHYSIOLOGICAL CONDITION OF A USER

(75) Inventors: William Dalebout, North Logan, UT (US); Scott R. Watterson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 217 days.

(21) Appl. No.: 13/565,765

(22) Filed: Aug. 2, 2012

(65) Prior Publication Data

US 2013/0035208 A1 Feb. 7, 2013

Related U.S. Application Data

(60) Provisional application No. 61/514,803, filed on Aug. 3, 2011.

(51) Int. Cl.

| | |
|---|---|
| ***A63B 71/00*** | (2006.01) |
| ***A63B 24/00*** | (2006.01) |
| ***A63B 15/02*** | (2006.01) |
| ***A63B 22/02*** | (2006.01) |
| ***A63B 71/06*** | (2006.01) |

(52) U.S. Cl.

CPC ..... *A63B 22/02* (2013.01); *A63B 71/0622* (2013.01); *A63B 24/0062* (2013.01); *A63B 2230/755* (2013.01); *A63B 2024/009* (2013.01); *A63B 2024/0093* (2013.01); *A63B 2071/0625* (2013.01); *A63B 2225/50* (2013.01); *A63B 2230/00* (2013.01); *A63B 2230/045* (2013.01); *A63B 2230/062* (2013.01); *A63B 2230/305* (2013.01); *A63B 2230/015* (2013.01)

USPC ..... 482/8; 482/4; 482/1

(58) Field of Classification Search

USPC ..... 482/1, 8

See application file for complete search history.

(56) References Cited

U.S. PATENT DOCUMENTS

| | | | | |
|---|---|---|---|---|
| 4,580,983 | A * | 4/1986 | Cassini et al. | 482/61 |
| 5,240,417 | A * | 8/1993 | Smithson et al. | 434/61 |
| 6,450,922 | B1 * | 9/2002 | Henderson et al. | 482/8 |
| 6,527,796 | B1 * | 3/2003 | Magovern | 607/81 |
| 6,543,247 | B2 * | 4/2003 | Strauss | 62/259.3 |
| 6,800,050 | B2 * | 10/2004 | Moavro et al. | 482/8 |
| 6,878,099 | B2 * | 4/2005 | Corbalis et al. | 482/54 |
| 7,260,950 | B2 * | 8/2007 | Choi et al. | 62/180 |
| 7,481,744 | B2 * | 1/2009 | Reyes et al. | 482/54 |
| 7,618,345 | B2 * | 11/2009 | Corbalis et al. | 482/8 |
| 8,038,577 | B2 * | 10/2011 | McIntosh | 482/4 |
| 2001/0001303 | A1 * | 5/2001 | Ohsuga et al. | 482/5 |
| 2003/0134714 | A1 * | 7/2003 | Oishi et al. | 482/6 |
| 2003/0181289 | A1 * | 9/2003 | Moavro et al. | 482/4 |

(Continued)

*Primary Examiner* — Loan H Thanh
*Assistant Examiner* — Shila Jalalzadeh Abyane
(74) *Attorney, Agent, or Firm* — Workman Nydegger Holland & Hart LLP

(57) ABSTRACT

In general, exercise devices of the present invention include one or more fans that can increase the flow of air in particular direction. Exercise devices of the present invention also include a sensing mechanism that can sense a physiological condition of a user performing an exercise on the exercise device. The sensed physiological condition could be pulse, blood pressure, respiration, caloric expenditure, weight, perspiration, temperature, blood oxygen level, metabolic equivalent of task (MET), carbohydrates burned, cadence or another physiological condition. The speed of the air flow created by the fan can depend on the physiological condition sensed by the sensing mechanism.

20 Claims, 3 Drawing Sheets

(56) References Cited

U.S. PATENT DOCUMENTS

| | | | | |
|---|---|---|---|---|
| 2004/0018917 | A1* | 1/2004 | Corbalis et al. | 482/54 |
| 2004/0018918 | A1* | 1/2004 | Reyes et al. | 482/54 |
| 2004/0092367 | A1* | 5/2004 | Corbalis et al. | 482/54 |
| 2006/0123814 | A1* | 6/2006 | Choi et al. | 62/180 |
| 2007/0032351 | A1* | 2/2007 | Reyes et al. | 482/54 |
| 2007/0123390 | A1* | 5/2007 | Mathis | 482/8 |
| 2009/0253554 | A1* | 10/2009 | McIntosh | 482/4 |
| 2010/0035726 | A1* | 2/2010 | Fisher et al. | 482/8 |

* cited by examiner

EXERCISE DEVICE WITH FAN CONTROLLABLE BY A PHYSIOLOGICAL CONDITION OF A USER

CROSS-REFERENCE TO RELATED APPLICATIONS

This application claims priority from U.S. provisional application No. 61/514,803 filed on Aug. 3, 2011.

BACKGROUND OF THE INVENTION

1. The Field of the Invention

In general, the present invention relates to exercise devices. More specifically, the present invention relates to fans on exercise devices, where the speed of the fan is dependent, at least in part, on a physiological condition of a user performing an exercise on the exercise device.

2. The Relevant Technology

Conventional exercise devices attempt to make exercising as comfortable and automated as possible. In an effort to make exercising more comfortable, many exercise devices include fans to cool a user during performance of an exercise. Some conventional exercise devices provide a user with two or more fan speed options (for example, high and low). These conventional devices may provide a user with a button or buttons to turn a fan on and off and to select the speed of the fan. These buttons may be located on a console or another convenient location on an exercise device. The fans on conventional exercise devices may also be directional such that a user can direct the flow of air from the fan in a desired direction.

With other conventional exercise machines, the speed of a fan may be based on a specific parameter of the exercise device. For example, fan speed may be based on the speed that a belt is moving on a treadmill. Fan speed may also be based on the resistance level on an exercise bike or elliptical machine. These exercise devices provide a bit more automation by eliminating the need for the user to manually set the fan to a specific speed. However, the fan may not be at a preferred speed when based on a specific parameter of the exercise device.

Conventional exercise devices do not, however, provide a fan whose speed is based, at least in part, on a physiological condition of the user that is performing the exercise. These physiological conditions may include, but are not limited to, pulse, blood pressure, respiration, caloric expenditure, weight, perspiration, temperature, blood oxygen level, metabolic equivalent of task, carbohydrates burned, and cadence. Thus, an exercise device having a fan, where the speed of the fan is controlled by one or more physiological conditions of a user performing an exercise is required.

BRIEF SUMMARY OF THE INVENTION

The present invention solves one or more of the foregoing problems by providing an exercise device with at least one fan. The exercise device also includes a sensing mechanism that senses at least one physiological condition of a user performing an exercise on the exercise device. The speed of the fan is determined, at least in part, by the sensed physiological condition of the user.

In one exemplary embodiment, an exercise device includes a frame and a movable element that is operably associated with the frame, where the movable element is movable relative to the frame during performance of an exercise. The exercise device also includes a fan that is connected to the frame and that increases air flow in a particular direction. The exercise device further includes a sensing mechanism that senses at least one physiological condition of a user that is performing an exercise with the movable element. Finally, the exercise device includes a processing unit that is in communication with both the sensing mechanism and the fan, where the speed of the air flow created by the fan depends, at least in part, on the physiological condition of the user.

In another exemplary embodiment, an exercise device includes a frame and a movable element that is operably associated with the frame, where the movable element is movable relative to the frame during performance of an exercise. The exercise device also includes a fan that is connected to the frame and that increases air flow in a particular direction. The exercise device further includes a pulse sensing mechanism that senses a user's pulse while the user performs an exercise with the movable element. Finally, the exercise device includes a processing unit that is in communication with both the sensing mechanism and the fan, where the speed of the air flow created by the fan depends, at least in part, on the pulse of the user.

In another exemplary embodiment, a method for controlling the speed of a fan on an exercise device is disclosed. The method includes the step of providing an exercise device having a frame, at least one moveable element, a fan, a sensing mechanism, and a processing unit that is in communication with both the sensing mechanism and the fan. The method includes the step of sensing a physiological condition of a user exercising with the exercise device and receiving information regarding the physiological condition at the processing unit. The method further includes the step of adjusting the speed of the fan based, at least in part, on the physiological condition.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

In general, embodiments of the invention include an exercise device with at least one fan. The exercise device also includes a sensing mechanism that senses at least one physiological condition of a user performing an exercise on the exercise device. The speed of the fan is determined, at least in part, by the sensed physiological condition of the user.

Unless specified or limited otherwise, the terms "attached," "mounted," "connected," "supported," "coupled," "secured" and variations thereof are used broadly and encompass both direct and indirect attachments, mountings, connections, supports, couplings and securings. Further, these terms are not restricted mechanical attachments but also include frictional, adhesive, magnetic and other attachments.

Figure 1:
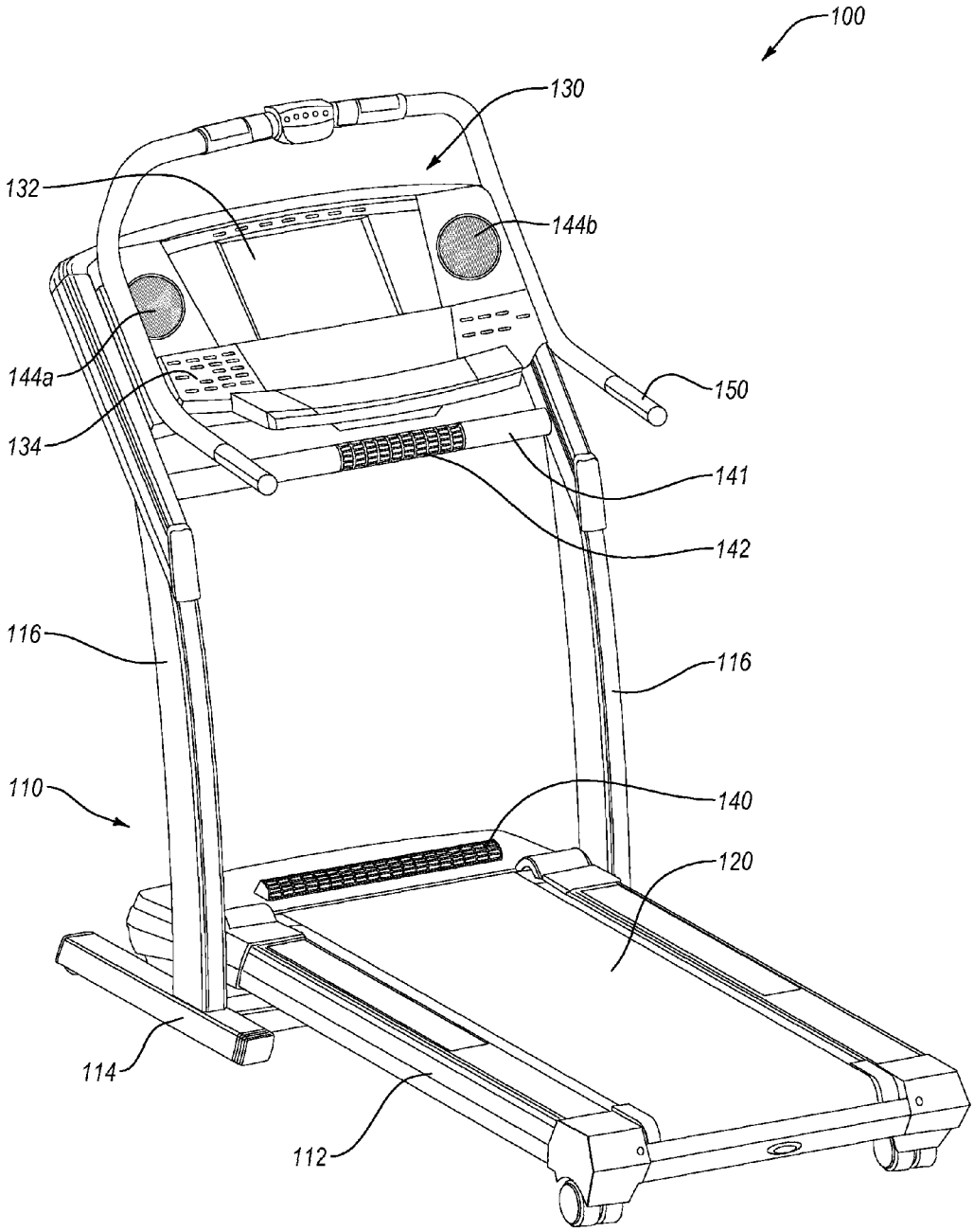
FIG. 1 illustrates a perspective view of an exercise device according to the present invention.

FIG. 1 illustrates a perspective view of an exercise device according to one embodiment of the present invention. While the exercise device illustrated in FIG. 1 is a treadmill 100, one of skill in the art will recognize that the invention disclosed herein is not limited to any particular type of exercise device. Accordingly, the term "exercise device" shall refer broadly to any type of exercise device including, but not limited to, treadmills, exercise bikes, Nordic style ski exercise devices, rowers, steppers, hikers, climbers, and elliptical and striding exercise machines.

Treadmill 100 includes a frame 110. A frame can be any part of an exercise device that imparts structural support and/or stability to the exercise device. With regard to treadmill 100, frame 110 includes a base frame portion 112, a foot frame portion 114, and upright frame portions 116. Each part of frame 110 is preferably made of metal, but can also be made of any material of suitable strength including plastic, ceramic, composite materials, or combinations thereof.

Treadmill 100 also includes movable elements, including a belt 120. Belt 120 is operably associated with base frame portion 112 and moves during a user's performance of an exercise on exercise device 100. Specifically, belt 120 provides a surface upon which a person using exercise device 100 may walk or run. A movable element need not be a belt, but can be any piece or portion of an exercise device that moves during performance of an exercise. For example, a movable element could include pedals on exercise bikes, foot and/or arm linkages on Nordic style ski devices, steppers, ellipticals, and striders. A movable element could also include a seat and/or handle members on a rower.

Treadmill 100 further includes a console 130. Console 130 can be attached to and supported by upright frame portions 116. Console 130 includes a display screen 132, which can display a wide variety of exercise-related data. Exercise-related data could include for example a resistance level, a speed or incline setting, and information regarding a user's heart rate, number of calories burned, or another physiological condition. Display screen 132 can also provide entertainment for a user who is exercising on treadmill 100. For example, display screen 132 could display television programming or scenic images from a trail.

Console 130 also includes buttons 134. These buttons 134 can be used to control one or more of the parameters of the treadmill. For example, buttons 134 may control the speed or incline of treadmill 100. Buttons 134 can also be used to select a programming option provided by treadmill 100. As discussed in more detail in connection with FIG. 3, console 130 can further include buttons for controlling one or more fans that are included on treadmill 100.

Fans are often included on exercise devices to make working out more comfortable or to create a more realistic experience for the user. A fan can be any mechanism that increases the flow of air in a particular direction. A fan may be comprised of several different components. For example, a fan may include one or more fan blades and a motor, which rotates the one or more fan blades. Fan blades can be shaped such that as they rotate, increased air flow is created in a particular direction.

Fans may also include one or more entrance vents and one or more exit vents. Entrance and exit vents may simply define openings on opposing sides of fan blades, which provide access to and from the blades. Entrance and exit vents may include air permeable coves that allow air to pass through but prevent objects from contacting the blades. The blades of a fan may, but need not, be located directly in front of an entrance vent or directly behind an exit vent. Further, more than one entrance vent may provide access to fan blades and more than one exit vent may provide an outlet away from the blades. Fans may additionally include air filters that clean dust and other particles from the air. Fans may further include an air freshener or another device that introduces a scent into the air.

Fans may also include a directional adjustment mechanism. A directional adjustment mechanism can be any device that focuses the flow of air from a fan in a desired direction. For example, a directional adjustment mechanism could be one or more slats positioned in front of a fan blade. This type of directional adjustment mechanism is commonly used with interior car fans. The directional adjustment mechanism on an exercise device could be adjusted by hand. For example, a knob or other lever may be connected to the one or more slats, which allow a user to angle the slats in a desired orientation. Alternatively the directional adjustment mechanism could be adjusted electronically by pressing one or more buttons on the console. For example, one button could raise the direction of the air flow produced by the fan. Another button could lower the direction of the air flow and other buttons could adjust the direction of the air flow left and right.

In the illustrated embodiment, treadmill 100 includes four fans 140, 142, 144*a* and 144*b* that are positioned in different locations on treadmill 100. Fan 140 is located near the belt 120. Fan 140 can blow air upward toward a user's legs or torso. A second fan 142 is located on a bar 141 that extends between upright frame portions 116. Bar 141 can be positioned anywhere between upright frame portions 116. Two additional fans 144*a* and 144*b* are located on console 130. The speed of the air flow from each of fans 140, 142, 144*a*, and 144*b* can be selectively adjustable.

These are not the only places on a treadmill or another exercise device where fans can be located. Indeed, fans can be located anywhere on an exercise device. For example, fans may be positioned on upright frame portions 116. Fans could also be placed on one or both lateral sides of a person working out on an exercise device. Fans could even be placed behind or above a person working out on an exercise device. In addition, an exercise device according to the present invention may have any number of different fans. In one embodiment, an exercise device may only have a single fan. Fans can also vary in both size and shape.

Treadmill 100 also includes a sensing mechanism (e.g., 150), which senses a physiological condition of a user performing an exercise with movable element 120. A physiological condition of a user can be any piece of data regarding the user's body including movement of the user's body. For example, physiological conditions include, but are not limited to, pulse, blood pressure, respiration, caloric expenditure, weight, perspiration, temperature, blood oxygen level, metabolic equivalent of task (MET), carbohydrates burned, and cadence.

In treadmill 100 the physiological condition may be a user's pulse. The sensing mechanism may be an electrocardiogram (EKG) hand grip pulse monitor 150. EKG hand grip pulse monitors are commonly found on conventional exercise devices. EKG hand grip pulse monitor 150 measures cardiac waveforms generated by electrical activity of the heart muscle. The cyclical contraction and relaxation of the heart involves polarization and depolarization of heart muscle fibers. This creates an electrical current that moves through the body, and which can be measured by EKG hand grip pulse monitor 150.

In other embodiments, a user's pulse may be sensed by a pulse oximeter. Typically, pulse oximeters have a pair of small light-emitting diodes (LEDs) facing a photodiode through a translucent part of the body, usually a fingertip or an earlobe. One LED may be red (with a first wavelength) and the other may be infrared (with a second, different wavelength). Blood absorbs the wavelengths produced by these lights differently depending on the oxygenation level of the blood. Thus, a pulse oximeter may measure pulse by recognizing spikes in blood oxygen levels.

Figure 2:
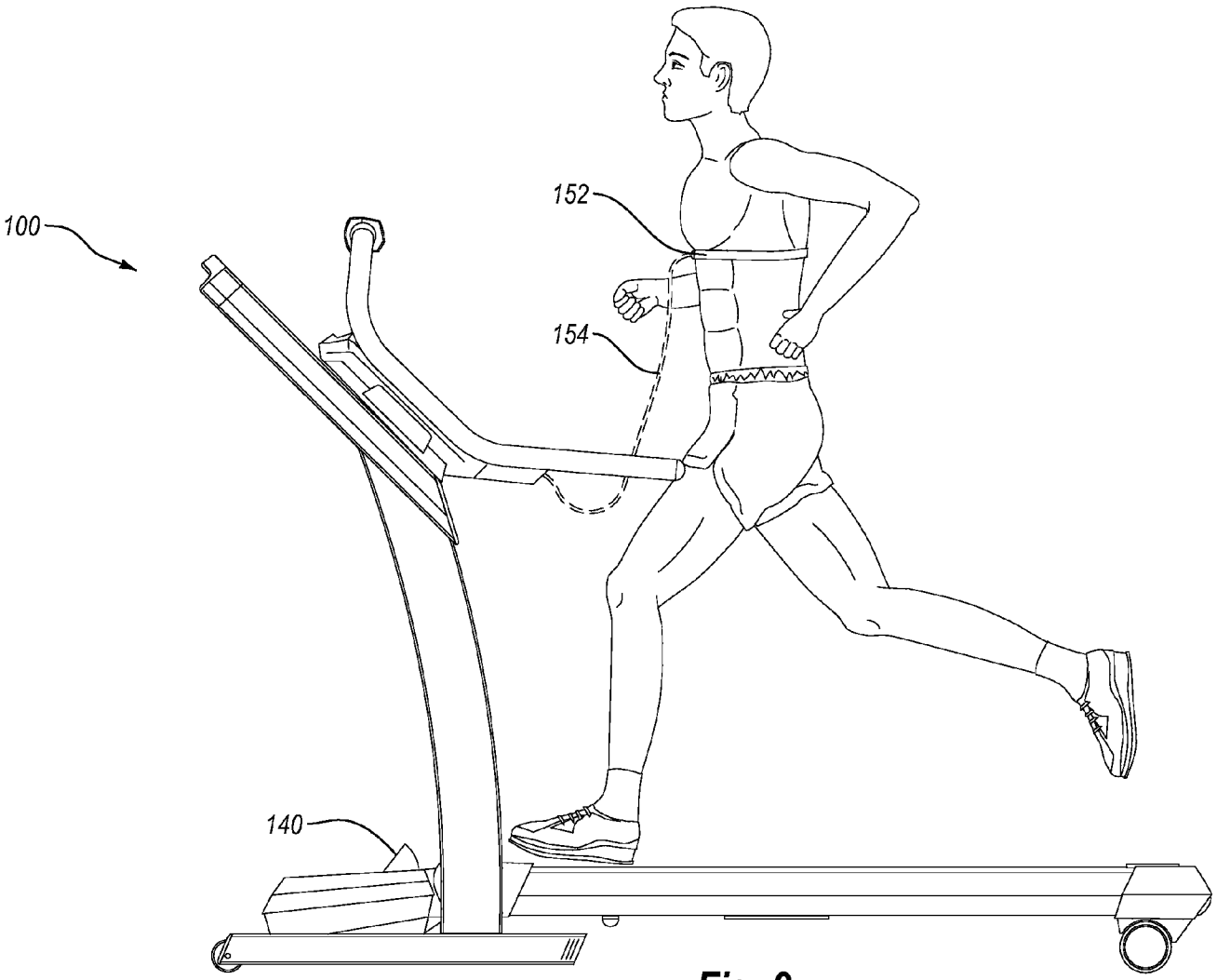
FIG. 2 illustrates a side view of the exercise device shown in FIG. 1.

A user's pulse may also be sensed through an EKG band or strap that the user wears while he or she exercises. For example, FIG. 2 illustrates treadmill 100 with a person performing an exercise thereon. An EKG chest strap pulse monitor 152 is secured around the chest of the user. EKG chest strap pulse monitor 152 includes a conductive material (not shown) that is in direct contact with the user's skin. Through this contact, the user's pulse can be measured in much the same way as EKG hand grip pulse monitor 150. As described in more detail hereafter, EKG chest strap pulse monitor 152 communicates the pulse data through a connection 154. Connection 154 may be a wire or a wireless signal sent by EKG chest strap pulse monitor 152.

Treadmill 100 also includes a processing unit (not shown). A processing unit can be a computer, a microprocessor, a microcontroller, state machine or other similar device that includes circuitry for controlling the operation of one or more features on an exercise device. For example, a processing unit on a treadmill may receive input from buttons or another source regarding the speed of the belt. A processing unit on an exercise bike may receive input from buttons or another source regarding the amount of resistance to apply to a flywheel.

The processing unit may be housed within console 130 or in another location on treadmill 100. In alternative embodiments, a processing unit may be external from the exercise device with which it is in communication. Processing units may also convert exercise-related data into a format that is displayable to a user. For example, a processing unit may convert data regarding movement of a treadmill belt into a numerical figure representing miles per hour or kilometers, which can be displayed on a display screen. The circuitry within processing unit is available and may be easily assembled by those skilled in the art.

Figure 3:
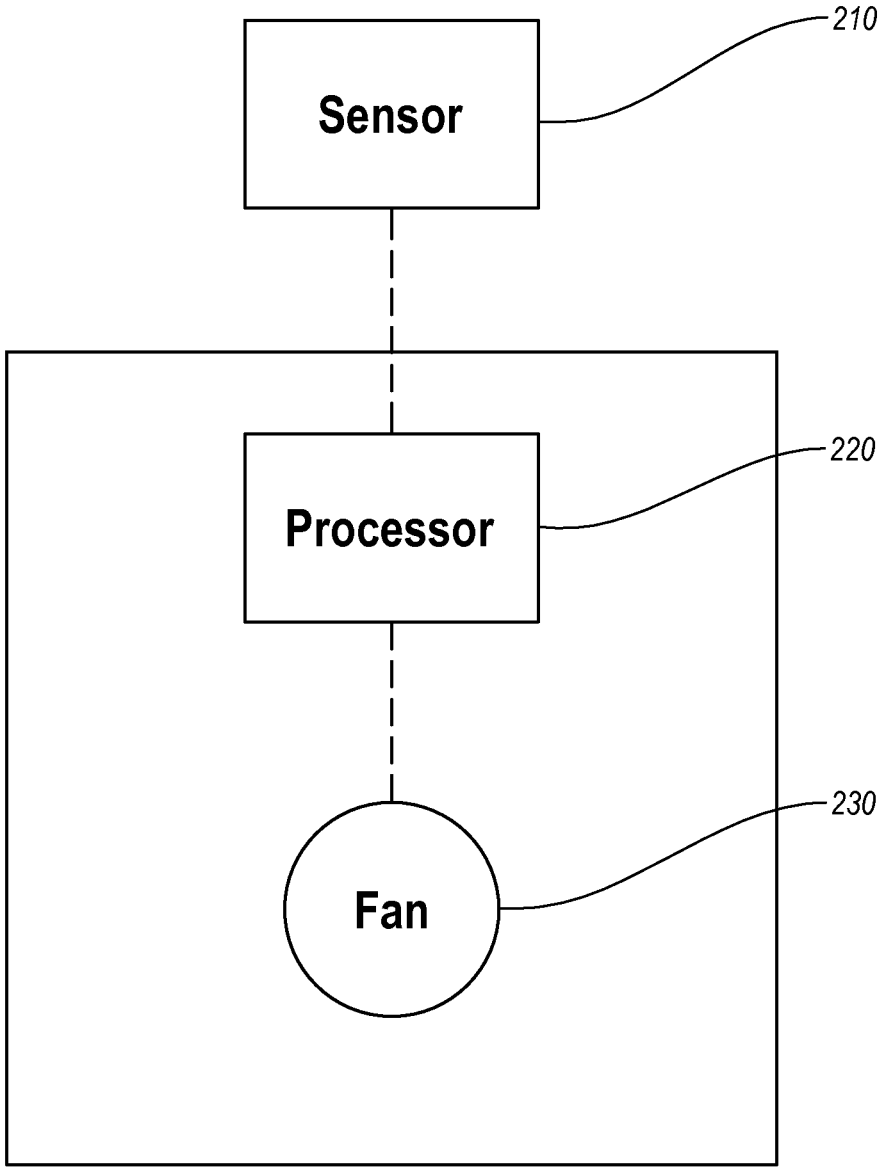
FIG. 3 illustrates a block diagram of components that can be used in connection with the present invention.

A processing unit may also be in communication with a sensing mechanism to receive data regarding a physiological condition of a user performing an exercise on the exercise device. FIG. 3 illustrates a block diagram showing the relationship between a sensing mechanism 210, a processing unit 220, and a fan 230. The processing unit 220 is communicatively connected to the sensing mechanism 210. This connection may be a wired or wireless connection. For example, treadmill 100 illustrated in FIG. 2 includes a connection 154 between the EKG chest strap pulse monitor 152 and a processing unit on treadmill 100. This connection may include a wire or the connection may be wireless. The processing unit 220 in FIG. 3 is also communicatively connected to the fan 230. This connection may also be a wired or wireless connection.

Once processing unit 220 has received data regarding a physiological condition of a user performing an exercise on the exercise device from sensing mechanism 210, processing unit 220 can use that data to, in whole or in part, control the speed of air flow created by fan 230. Processing unit 220 can be programmed to use the data regarding a physiological condition in a variety of different ways. For example, if sensing mechanism 210 were a pulse sensor, processing unit 220 could be programmed such that the speed of air flow created by fan 230 is determined, at least in part, by the user's pulse rate. In this embodiment, the speed of air flow created by fan 230 could increase as the user's heart rate increased. The speed of the fan could decrease as the user's heart rate decreased.

In another embodiment, the speed of air flow created by a fan could be based on a total number of pulses (or other physiological piece of accumulating data) instead of a rate related thereto. For example, the processing unit could be programmed such that the speed of air flow created by a fan increases as the total number of pulses goes up. With a fan that has three different speeds, the processing unit could be programmed to change the fan from the first speed to the second speed after one thousand user pulses. The processing unit could be programmed to change the fan from the second speed to the third speed after two thousand user pulses.

In yet another embodiment, fan speed could be used as an incentive for a user to achieve a target physiological condition or maintain a physiological condition within a target range. For example, a user could identify a target heart rate. The processing unit could be programmed such that the speed of air flow created by the fan is highest when the user's pulse rate is at the identified target rate. In this embodiment, the speed of air flow created by the fan could decrease as the user's heart rate strayed in either direction away from the identified target rate.

INDUSTRIAL APPLICABILITY

In general, exercise devices are disclosed herein that include a fan where the speed air flow created by the fan is, at least in part, dependant on a physiological condition of a user performing an exercise on the exercise device. As described above, one physiological condition upon which the fan speed can be dependant is pulse. In other embodiments, fan speed can be determined by a user's blood pressure. In this embodiment, the sensing mechanism could be a blood pressure cuff or another device worn by a user that measures blood pressure. Data from the blood pressure sensing mechanism could be communicated to a processing unit via a wire or wireless connection. In one application, the processing unit could be programmed such that as the user's blood pressure increases, the speed of air flow created by the fan also increases. As a user's blood pressure decreases, the speed of air flow created by the fan could also decrease.

In another embodiment, fan speed can be determined by a user's respiration. In this embodiment, the sensing mechanism could be a respiration monitor belt or another device that senses respiration. A respiration monitor belt can be secured around a user's chest. The pressure associated with the expansion and contraction of the chest during breathing can be monitored to determine respiration. Data from the respiration sensing mechanism could be communicated to a processing unit via a wire or wireless connection. In one application, the processing unit could be programmed such that as the user's respiration rate increases, the speed of air flow created by the fan also increases. As a user's respiration rate decreases, the speed of air flow created by the fan could also decrease.

In another embodiment, fan speed can be determined by a user's caloric expenditure. Caloric expenditure can be measured directly, which requires the measurement of the heat released by the body, or indirectly be measuring ventilation and the exchange of oxygen and carbon dioxide by the body. Devices for measuring caloric expenditure directly (also termed "direct calorimetry") and indirectly (also termed "indirect calorimetry") are known in the art. Data from the caloric expenditure sensing mechanism could be communicated to a processing unit via a wire or wireless connection. In one application, the processing unit could be programmed such that as the user's rate of caloric expenditure increases, the speed of the air flow created by fan also increases. As a user's rate of caloric expenditure decreases, the speed of air flow created by the fan could also decrease. In another application, the processing unit could be programmed such that speed of air flow created by the fan increases as the user achieves different numbers of total calories burned. For example, every two hundred calories burned, the fan could be stepped up to a higher speed.

In another embodiment, fan speed can be determined by a user's weight. A user's weight can be measured with, for example, a scale positioned below a portion of the exercise device on which the user rests his or her weight. Data from the weight sensing mechanism could be communicated to a processing unit via a wire or wireless connection. In one application, the processing unit could be programmed such that the speed of air flow created by the fan is determined by the weight of the user.

In another embodiment, fan speed can be determined by a user's perspiration. In this embodiment, the sensing mechanism could be an armband or other device worn by a user having electrodes that measure skin conductivity or another device that measures perspiration. How much electrical current can pass between two points on the surface of the skin (or "skin conductivity") is affected by perspiration. Measuring skin conductivity can determine the amount that a person is perspiring. Data from the perspiration sensing mechanism could be communicated to a processing unit via a wire or wireless connection. In one application, the processing unit could be programmed such that as the amount of user perspiration increases, the speed of air flow created by the fan also increases. As the amount of user perspiration decreases, the speed of air flow created by the fan could also decrease.

In another embodiment, fan speed can be determined by a user's skin or body temperature. In this embodiment, the sensing mechanism could be a thermistor-based sensor or a thermometer attached to the body of a person performing an exercise or another device that senses temperature. Data from the temperature sensing mechanism could be communicated to a processing unit via a wire or wireless connection. In one application, the processing unit could be programmed such that as the user's temperature increases, the speed of air flow created by the fan also increases. As a user's temperature decreases, the speed of air flow created by the fan could also decrease.

In another embodiment, fan speed can be determined by a user's blood oxygen level. In this embodiment, the sensing mechanism could be a pulse oxymeter or another device worn by a user that measures blood oxygen levels. Data from the blood oxygen sensing mechanism could be communicated to a processing unit via a wire or wireless connection. In one application, the processing unit could be programmed such that as the user's blood oxygen level decreases, the speed of air flow created by the fan increases. As a user's blood oxygen level increases, the speed of air flow created by the fan could decrease.

In another embodiment, fan speed can be determined by a user's metabolic equivalent of task (MET). In this embodiment, the sensing mechanism could be a mask that measures oxygen consumption and carbon dioxide exhalation or another device that senses a user's MET level. Data from the MET sensing mechanism could be communicated to a processing unit via a wire or wireless connection. In one application, the processing unit could be programmed such that as the user's MET increases, the speed of air flow created by the fan also increases. As a user's MET decreases, the speed of air flow created by the fan could also decrease.

In another embodiment, fan speed can be determined by a user's cadence, or foot falls during performance of an exercise. In this embodiment, the sensing mechanism could be an accelerometer worn by a user or another device that senses a user's foot falls. Data from the cadence sensing mechanism could be communicated to a processing unit via a wire or wireless connection. In one application, the processing unit could be programmed such that speed of air flow created by the fan increases as the user achieves different numbers of total foot falls. For example, every one thousand foot falls, the fan could be stepped up to a higher speed.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. An exercise device comprising:

a frame;

a movable element operably associated with the frame, the movable element being movable relative to the frame during performance of an exercise;

a fan connected to the frame that increases air flow in a particular direction;

a sensing mechanism that senses at least one physiological condition of a user performing an exercise with the movable element; and a processing unit in communication with both the sensing mechanism and the fan, wherein the speed of the air flow created by the fan is controlled based on a comparison between the at least one physiological condition sensed and a user identified target rate associated with the at least one physiological condition;

wherein the speed of the air flow created by the fan decreases if the at least one physiological condition sensed exceeds the target rate; and wherein the target rate identified by the user is programmed into the processing unit by the user.

2. The exercise device of claim 1, wherein the at least one physiological condition is pulse.

3. The exercise device of claim 2, wherein the sensing mechanism is an electrocardiogram pulse monitor.

4. The exercise device of claim 2, wherein the speed of the air flow created by the fan is dependent on the frequency of the user's pulse.

5. The exercise device of claim 2, wherein the speed of the air flow created by the fan is dependent on the total number of user's pulses.

6. The exercise device of claim 1, wherein the movable element is a treadmill belt.

7. The exercise device of claim 6, wherein the fan is located near the treadmill belt.

8. The exercise device of claim 1, wherein the fan includes a directional adjustment mechanism.

9. The exercise device of claim 8, wherein the directional adjustment mechanism can electronically be controlled by the user.

10. The exercise device of claim 1, wherein the sensing mechanism communicates with the processing unit via a wireless connection.

11. The exercise device of claim 1, wherein the at least one physiological condition is selected from the group consisting of respiration, caloric expenditure, perspiration, and temperature.

12. The exercise device of claim 1, wherein the at least one physiological condition is selected from the group consisting of blood pressure, weight, blood oxygen level, metabolic equivalent of task, carbohydrates burned, and cadence.

13. The exercise device of claim 1, wherein the movable element is a pedal that supports one or both feet of a user, which travels along a reciprocating path or about a closed loop during performance of an exercise.

14. The exercise device of claim 1 further comprising a console that displays information regarding the at least one physiological condition.

15. The exercise device of claim 1, wherein the fan includes at least three different speed levels.

16. An exercise device comprising:

a frame;

a movable element operably associated with the frame, the movable element being movable relative to the frame during performance of an exercise;

a fan connected to the frame that increases air flow in a particular direction;

a pulse sensing mechanism that senses a user's pulse while the user performs an exercise with the movable element; and a processing unit in communication with both the sensing mechanism and the fan, wherein the speed of the air flow created by the fan is controlled based on a comparison between the user's pulse sensed and a user identified target rate associated with the user's pulse;

wherein the speed of the air flow created by the fan decreases if the user's pulse sensed exceeds the target rate; and wherein the target rate identified by the user is programmed into the processing unit by the user.

17. The exercise device of claim 16, wherein the sensing mechanism communicates with the processing unit via a wireless connection.

18. The exercise device of claim 16, wherein the speed of the air flow created by the fan is dependent on the frequency of the user's pulse.

19. The exercise device of claim 16, wherein the speed of the air flow created by the fan is dependent on the total number of user's pulses.

20. A method for controlling the speed of a fan on an exercise device, the method comprising:

providing an exercise device having a frame, at least one moveable element, a fan, a sensing mechanism, and a processing unit that is in communication with both the sensing mechanism and the fan;

sensing a physiological condition of a user exercising with the exercise device;

receiving information regarding the physiological condition at the processing unit; and adjusting the speed of the fan based on a comparison between the physiological condition sensed and a user identified target rate associated with the physiological condition;

wherein the speed of the air flow created by the fan decreases if the physiological condition sensed exceeds the target rate; and wherein the target rate identified by the user is programmed into the processing unit by the user.

* * * * *